US006164901A

United States Patent [19]

Blotenberg

[11] Patent Number: 6,164,901

[45] Date of Patent: Dec. 26, 2000

[54] METHOD AND DEVICE FOR OPERATING TURBOCOMPRESSORS WITH A PLURALITY OF CONTROLLERS THAT INTERFERE ONE WITH EACH OTHER

[75] Inventor: Wilfried Blotenberg, Dinslaken, Germany

[73] Assignee: GHH Borsig Turbomaschinen GmbH, Germany

[21] Appl. No.: 09/336,444

[22] Filed: Jun. 18, 1999

[30] Foreign Application Priority Data

Jun. 26, 1998 [DE] Germany ..... 198 28 368

[51] Int. Cl.[7] ..... F01D 17/00

[52] U.S. Cl. ..... 415/1; 415/17; 415/28; 415/118

[58] Field of Search ..... 415/1, 17, 26, 415/28, 29, 47, 49, 50, 118; 701/99, 100; 60/39.02

[56] References Cited

U.S. PATENT DOCUMENTS

| | | | |
|---|---|---|---|
| 4,298,310 | 11/1981 | Blatenberg | 415/1 |
| 4,640,665 | 2/1987 | Staroselsky et al. | 415/1 |
| 4,946,343 | 8/1990 | Blatenberg | 417/27 |
| 5,347,467 | 9/1994 | Staroselsky et al. | 364/510 |
| 5,435,122 | 7/1995 | Ahlin et al. | 60/39.02 |
| 5,726,891 | 3/1998 | Sisson et al. | 364/431.02 |

FOREIGN PATENT DOCUMENTS 0 132 487 A2 2/1985 European Pat. Off. .

0 576 238 A1 12/1993 European Pat. Off. .

OTHER PUBLICATIONS

Kono Susumu et al. Nov. 25, 1997 Control Device for Compressor Patent Abstracts of Japan.

*Primary Examiner*—Edward K. Look
*Assistant Examiner*—James McAleenan
*Attorney, Agent, or Firm*—McGlew and Tuttle, P.C.

[57] ABSTRACT

A process for operating multistage turbocompressors (2, 22, 42) with a plurality of controllers (15, 35, 55) which interact one with each other, in which each compressor stage has anti-surge control valves (5, 25, 45) of its own, which recycle into the suction lines (1, 21, 41) of their respective own compressor stage (2, 22, 42). The control is performed by flow computers (6,26,46) for calculating the suction flow and computers (7,27,47) for determining the minimum acceptable flow from the delivery head. A comparison unit (12, 32, 52) determines the difference between the set point (derived from delivery head) minus the actual value (flow) and whenever the actual value is too low compared with the set point, it brings about a gradual opening of the corresponding surge line control valves (5, 25 and 45) until the actual flow exactly corresponds to the flow set point, which depends on the particular delivery head. The control takes place via a maximum selection (14, 34, 54), which is arranged upstream of the anti-surge controller (15, 35, 55) with the signal lines (16, 36, 56) to the surge line control valve (5, 25, 45).

18 Claims, 7 Drawing Sheets

METHOD AND DEVICE FOR OPERATING TURBOCOMPRESSORS WITH A PLURALITY OF CONTROLLERS THAT INTERFERE ONE WITH EACH OTHER

FIELD OF THE INVENTION

The present invention pertains to a method and a device for operating turbocompressors with a plurality of controllers that interfere one with each other.

BACKGROUND OF THE INVENTION

Turbocompressors are frequently equipped with a plurality of controllers. The anti-surge controller of a turbocompressor monitors, e.g., the position of the compressor working point in the characteristic diagram and opens an anti-surge control valve to the suction side or the atmosphere in the case of an unacceptably low compressor throughput. To adapt the turbocompressors to the needs of the process side, pressure or flow controllers, whose control units are formed by adjustable guide blades or throttle valves, are frequently used. The speed may also be adjusted for adjusting the capacity in the case of compressors with variable-speed drives.

The adjustment of the anti-surge control valve also influences the compressor discharge pressure and the flow to the process. Adjustment of the control unit of the process variable controller influences the position of the working point in the characteristic diagram and may let the anti-surge controller act as a result.

As a critical turbomachine protective controller, the anti-surge controller is usually set to the fastest possible response behavior. The fastest controllers available, which actuate the fastest valves available, are used for surge line control.

The process variable control must be adapted to the time response of the process. Pressure controls, in particular, are characterized by markedly longer time constants than are necessary for surge line controls. As a result, it is ensured in the normal case that the different control circuits do not interact one with each other in an unacceptable manner. The anti-surge controller corrects a disturbance substantially more rapidly than the process variable controller. It will have brought the surge line control valve into the necessary new position before the process variable controller has responded noticeably. An additional uncoupling of the anti-surge controllers among each other is not necessary in these cases.

However, there are applications in which the anti-surge controller must respond slowly or the process variable controller must respond quickly. The interfere one with each other of the controllers on each other cannot be ruled out in these applications. A disturbance on the compressor suction side may cause, e.g., the working point to move somewhat closer to the surge line.

The anti-surge controller responds to this and opens somewhat the surge line control valve to protect the compressor. As a result, less medium is delivered into the process and the flow (or the pressure) decreases on the delivery side of the compressor. The process variable controller notices this and increases the delivery capacity of the compressor. The consequence of this is that the working point moves away from the surge line. The anti-surge controller now responds to this and closes the surge line control valve correspondingly. However, this allows the pressure as well as the flow to increase on the delivery side of the compressor. The process variable controller responds to this by correspondingly reducing the delivery capacity of the compressor. However, this will again move the working point into the vicinity of the surge line, so that the anti-surge controller will again open the surge line control valve. The process begins anew and may lead to a continuous variation of the process variable and of the surge line control valve if the time parameters are selected unfavorably and the phase position is unfavorable.

Turbocompressors with a plurality of stage groups are protected with individual surge line controls per stage group, especially if side streams or intermediate extractions are used between the different stages. Interfere one with each other of the anti-surge controllers on each other may occur in this case as well. If the pressure ratio is increased over the low pressure stage due to a disturbance on the suction side of the low-pressure stage, the working point of this stage moves in the direction of the surge line, as a result of which an intervention of the anti-surge controller of the low-pressure stage, which opens the surge line control valve of the low-pressure stage somewhat, may become necessary. This causes a reduction in the discharge pressure of the low-pressure stage which is identical to the inlet pressure of the high-pressure stage. This is accompanied by an increase in the pressure ratios of the high-pressure stage, which leads to the opening of the surge line control valve of this stage. Since the surge line control valves release the pressure-side gas toward the suction side in gas compressors, an opening of the high pressure-side surge line control valve causes an increase in the suction pressure of this stage and consequently an increase in the discharge pressure of the low-pressure stage. The surge line control of the low-pressure stage is forced as a result to intervene more, and the low-pressure surge line control valve opens wider.

It is quite possible in the case of rapid transient processes for the anti-surge controller to act more violently than would be absolutely necessary, and the surge line control valve is opened wider than is necessary for the protection of the compressor. The consequence of this is that the surge line control valve will again be closed after the first disturbance has been balanced. Since the disturbance has begun in the low-pressure part, the anti-surge controller of the low-pressure stage will again close this valve. The discharge pressure of this stage thus increases and so does the suction pressure of the high-pressure stage as well. The pressure ratio of the high-pressure stage decreases and the corresponding anti-surge controller closes the high pressure-side surge line control valve. This will again influence the low-pressure part, etc. If the controllers are set such that they respond to a transient disturbance with a certain overmodulation, a phase-shifted interfere one with each other of the two anti-surge controllers on each other cannot be ruled out.

The risk of interactions increases if not only two compressor stage groups, but three or more compressor stages are arranged in series. The process is applicable not only to anti-surge controllers, but in general.

SUMMARY AND OBJECTS OF THE INVENTION

The primary object of the present invention is to provide a method for uncoupling the control circuits in such a way that an oscillation-exciting interaction of the control circuits among each other is avoided even if all variables have the same time response.

According to the invention, a method is provided for operating turbomachines having stages with at least two controllers that interact one with each other. The method comprises providing the first controller as a anti-surge controller and mutually exchanging correction variables of the first and the second controller for use in control. A variance comparison is provided by the two controllers. The variance comparison of the two controllers is acted on by each of the controllers. An uncoupling of the manipulated variable outputs of the two controllers is provided such that a interfere one with each other of one control on the state of the other stage is at least markedly reduced.

The invention also provides a device for carrying out the process for operating multistage turbocompressors. The device includes a variance comparison unit connected to one of the stages of the multistage turbocompressors. Another variance comparison unit is connected to one of the stages of the multistage turbocompressors. The comparison units preferably determines the difference between the set point (determined from delivery head) minus the actual value (flow) for generating a signal such that whenever the actual value is too low compared with the set point, it brings about a gradual opening of the corresponding surge line control valves until the actual value of the flow exactly corresponds to the flow set point, which depends on the particular delivery head. Control lines are provided from the comparison units. A first anti-surge controller and a second anti-surge controller are provided. The first controller and the second controller interact one with each other when they act based on the signal from respective comparison units. A maximum selector is provided for receiving mutually exchanged correction variables transferred from the variance comparison unit via the control lines. The maximum selector is arranged upstream of each anti-surge controller of one said turbocompressor stage. The anti-surge controller acts on the surge line control valves via the control lines.

A method for uncoupling the controllers is developed according to the present invention for such a control circuit architecture. The object of the uncoupling method is to eliminate the interaction of the individual controllers and to offer complete freedom in the selection of the controller parameters. Therefore, what is proposed here is not a method for protecting compressors from surge, but a method by which interactions between different controllers, e.g., surge line and process variable controllers, are avoided.

A typical machine line for compressing gas comprises three stage groups arranged in series in the direction of flow (see FIG. 1).

Other control requirements are also possible and the method can be applied to them as well. One of these stages comprises the suction line of the low-pressure stage, the compressor, the discharge pressure pipe and a recycle line with the surge line control valve, as well as a flow computer for calculating the suction flow as well as a computer for determining the delivery head. The computers are connected via signal lines to the pipelines and via additional signal lines to a comparison unit. The comparison unit determines the difference between the flow set point (determined from delivery head) minus the actual value (flow) and whenever the actual value is too low in relation to the set point, it brings about a gradual opening of the anti-surge control valve until the actual flow exactly corresponds to the flow set point, which depends on the actual delivery head. The adjustment is performed according to the present invention via the maximum selection, the PI controller as well as the signal line to the anti-surge control valve. A check valve uncouples the first compressor from the downstream medium-pressure stage.

The results of a variance comparison are transmitted via a control line directly to the anti-surge controller, which adjusts the anti-surge control valve via a control line.

If the actual flow is lower than the flow set point that depends on the delivery head, the control deviation determined in the comparison unit becomes positive and adjusts the output of the anti-surge controller via the control line to have the anti-surge control open the valve mode widely.

The controllers are preceded according to the present invention by a maximum selection, one input of which is the known difference between the set point and the actual value of the corresponding compressor. The control deviation (control error) of the other compressor stages are also imposed on this maximum selection. The action of the control deviation is such that a positive signal allows the controller output to decrease and thus the anti-surge control valve opens, and a negative signal closes the surge line control valve. The maximum selection now causes that whenever one of the three machines reaches an operating range that requires the opening of the surge line control valve, this variable is imposed on all three anti-surge controllers, and each controller will correspondingly open its corresponding surge line control valve via the control lines. A interfere one with each other is ruled out as a result, because all surge line control valves open simultaneously and, if the controller setting is the same, also by the same amount.

If all three compressor stages have again left the hazardous working range, in which the flow is smaller than acceptable, by opening the surge line control valves, the maximum selection members send the control deviation which closes the surge line control valve with the smallest gradient to the controller.

In another embodiment of the present invention, an arrangement for influencing the control deviations may be interposed between the comparison units and the maximum selection.

The control deviation is sent via a signal line to a first-order time element and to an adding limiter. This limiter adds up the inputs correctly as to their signs, i.e., it subtracts from the control deviation the control deviation delayed via the time element. This variation equals zero in the steady state, so that the adder merely passes on the signal of the maximum selection. The limiter is set to a range of 0 to 1, and it limits negative values to the value zero.

Should the working point now move toward the control line, the output signal of the time element follows with a time delay. In the case of a great change in the control deviation, the output signal of the limiter may already become positive when the control deviation itself is still negative. On the other hand, the action of the correction variable becomes zero when the control deviation stationarily assumes a value different from zero.

If needed, a constant may also be added to the inputs of the limiter. This constant causes an offset. The output of the limiter becomes greater than zero only when the difference between the other two input variables has exceeded the threshold value set as a constant.

This offset or this constant can, of course, also be used without the delaying action of the first-order time element.

It is obvious that the amount of the constant offset can be made dependent upon certain operating states or process variables.

These measures may, of course, also be applied when a anti-surge controller and a process variable controller are to be uncoupled.

The correction variable acts on the process variable controller such that when it comes closer to the surge line or when the control line is exceeded, the input of the process variable controller is changed such that it supports the action of the anti-surge controller and moves the compressor out of the dangerous range.

As a result, the process variable controller is prevented from counteracting the action of the anti-surge controller and a interfere one with each other of the controllers on each other is prevented hereby from occurring.

It may also be achieved, e.g., by selecting the parameters of the limiter that when the working points move closer to the surge line, the input signal of the process variable controller can be influenced such that only small gradients are allowed for reducing the compressor output. As a result, the process variable controller still acts, but it can intervene with a limited action only.

A similar action can also be achieved by a correction variable influenced via a limiter being sent to a minimal selection before the controller.

Another possibility of preventing interfere one with each others of different control circuits on one another is to limit the gradient for varying manipulated variables. To do so, a gradient limiter with integrated input amplifier, limiter and integrator is arranged downstream of the anti-surge controllers and process variable controllers.

The difference between the actual flow through the compressor and the minimum allowable flow is formed in the variance comparison unit and is sent via a signal line to the anti-surge controller, which adjusts the surge line control valve such that the compressor will not be operated in the unstable working range.

The set point of the process variable and the actual value of the process variable are sent to an additional comparison unit via the signal lines. The difference of these two values acts via a separate signal line and a limiter and a process variable controller. This process variable controller adjusts the corresponding control unit (guide vanes, throttling valve, speed) such that the actual value of the process variable will exactly correspond to the set point.

The limiter limits the control deviation of the process variable controller. Since the process variable controller is usually connected as a Proportional-Integral controller (PI controller), the limiter limits the gradient for the integral adjustment of the manipulated variable. If the limiter is set to the limit value zero, the manipulated variable of the process variable controller will not change any more at all.

The upper and lower limits of the limiter can be varied as a function of a process variable via an additional signal line. The control deviation of the anti-surge controller is now used as the manipulated variable. A function generator permits the definition of a nonlinear relationship between the control deviation of the anti-surge controller and the effective limits of the limiter. The control deviation of the anti-surge controller is proportional to the distance between the actual operating point and the anti-surge control line. Closer to the surge line, decoupling is more required than far away from the surge line. The function generator may be set, e.g., such that no limitation acts at a control deviation greater than 20%, the limitation can decrease e.g. with the second power of the control deviation down to a control deviation of 3%, and the lower limit is set to zero at a control deviation below 3%. Any other type of function, even a nonlinear one, can be set if needed. The upper and lower limits may also be varied separately. Two function generator are used in this case separately for the upper limit and for the lower limit.

Instead of a limitation of the control deviation, the function generator may also act directly on the controller output of the process variable controller and adjust it correspondingly.

In another embodiment of the present invention, a gradient limiter is arranged downstream of the controller (process variable controller or anti-surge controller). A signal line transmits the output variable of the controller (process variable controller or anti-surge controller) to the input amplifier of a gradient limiter. This amplifier is set to a high gain, so that the limiter receives a high input signal even in the case of a slight deviation between the output of the controller and the output of the gradient limiter, fed back via an additional signal line. The limit values of the limiter determine the gradient for the adjustment of the integrator. If the limiter is set to low values, the integrator receives only low input values and adjusts its output only slowly even in the case of a deviation at the input of the amplifier.

Via another control line, the limit values of the limiter can be adjusted in the same manner as was described above for the limitation of the control deviation of the anti-surge controller.

In the case of limitation of the gradient in the output of the controller, it shall be ensured by taking secondary measures that the output of the gradient limit will not unacceptably deviate from the output of the controller. The controller output is normally to be adjusted to the output of the limiter during the intervention of the output-side gradient limitation (controller output tracking).

In another embodiment of the present invention, the particular discharge pressure can be received on the output line of the high-pressure stage from a pressure measuring transducer and be sent to an additional comparison unit, wherein the actuating drives of the guide vanes of each of the three compressor stages can be acted on via an additional process variable controller.

Moreover, the current pressure can be picked up from a measuring transducer behind each compressor stage and be sent to a variance comparison unit. At the same time, controlled parameters are branched off between the maximum selection and the anti-surge controller and are sent to a function generator. This transmits its data to the above-mentioned additional process variable controller. Finally, an additional limiter, which passes on only specially selected controlled variables, may be arranged between the function generator and the process variable controller.

The present invention will be described in greater detail on the basis of schematic exemplary embodiments.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENT

Figure 1:
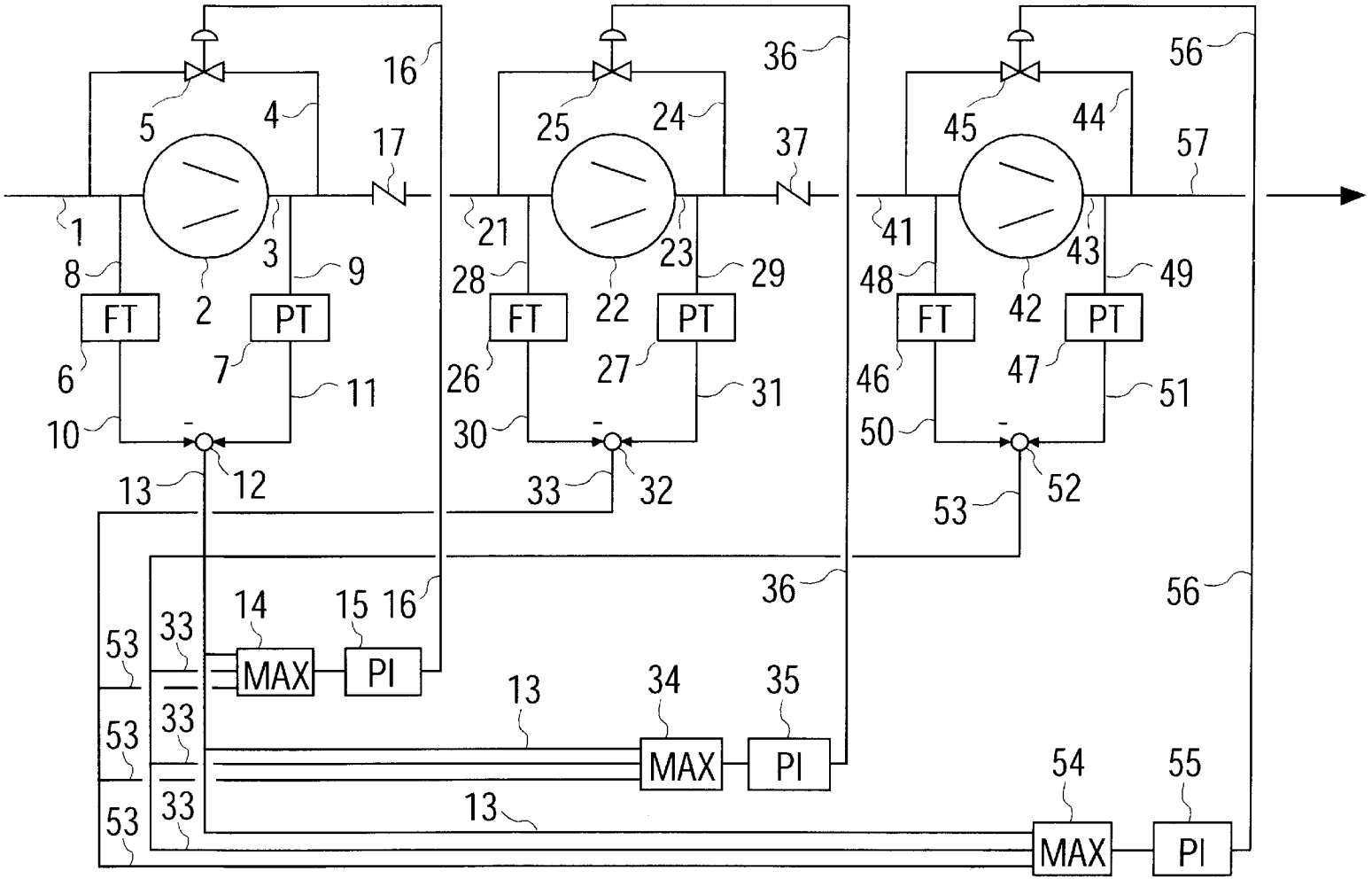
FIG. 1 is a circuit diagram for uncoupling the controllers of a three-stage turbocompressor for process gases.

Referring to the drawings in particular, FIG. 1 shows an arrangement for uncoupling the controllers of a three-stage turbocompressor, in which each compressor stage 2, 22, 42 has surge line control valves 5, 25, 45 of its own, which recycle flow into the suction lines 1, 21, 41 of the their respective own compressor stage 2, 22, 42.

A machine train for compressing gas comprises three stage groups 2, 22, 42 arranged one behind the other. The three-stage compressor comprises the respective suction lines 1, 21, 41, the low-pressure compressor 2, the medium-pressure compressor 22, and the high-pressure compressor 42, the discharge pressure lines 3, 23, 43, the recycle lines 4, 24, 44 with the surge line control valves 5, 25, 45, the flow computers 6, 26, 46 for measuring the suction flow, as well as the computers 7, 27, 47 for the minimum allowable flow set point, which is determined from the discharge pressure and the delivery head. To calculate the delivery head, the corresponding suction pressure and the suction temperature are also needed. The corresponding operating lines are not shown.

The computers 6, 7, 26, 27 and 46, 47 are connected via signal lines 8 and 9, 28 and 29 as well as 48 and 49 to the delivery pipelines and via two other signal lines 10 and 11, 30 and 31 as well as 50 and 51 to the comparison units 12, 32 and 52. Each comparison unit 12, 32, 52 determines the difference between the set point (derived from delivery head) minus the actual value (flow) and whenever the actual value is too low compared with the set point, it brings about a gradual opening of the corresponding surge line control valves 5, 25 and 45 until the actual value of the flow exactly corresponds to the flow set point, which depends on the particular delivery head. The adjustment takes place via a maximum selection 14, 34, 54, the anti-surge controllers 15, 35, 55, as well as the signal lines 16, 36, 56 to the surge line control valve 5, 25, 45. The check valve 17, 37 uncouples the low-pressure compressor 2 from the medium-pressure compressor 22.

The measured values/signals of the variance comparison 12, 32, 52 act via the control line 13, 33, 53 directly on the anti-surge controller 15, 35, 55, which adjusts the surge line control valve 5, 25, 45 via the control line 16, 36, 56.

If the actual value of the flow is lower than the flow set point that depends on the delivery head, the control deviation becomes positive and it adjusts the output of the anti-surge controller 15, 35, 55 in terms of a more widely opening valve 5, 25, 45.

The anti-surge controllers 15, 35, 55 are preceded by a maximum selection 14, 34 and 54, one input of which is the known difference between the set point and the actual value of the corresponding surge line control of the compressor stage. The control deviation of the other comparison units 32 and 52 is also imposed on this maximum selection. The effect of the control deviation is such that a positive signal allows the controller output 15, 35, 55 to drop, and thus it opens the surge line control valve 5, 25, 45, and a negative signal closes the surge line control valve 5, 25, 45. The maximum selection 14, 34, 54 now causes that whenever one of the three compressor stages 2, 22 or 42 enters an operating range that requires the opening of the surge line control valve 5, 22 or 42, this variable will be imposed on all three anti-surge controllers 15, 35 and 55, and each anti-surge controller 15, 35 or 55 will correspondingly open of its corresponding surge line control valve 5, 25, 45 via the control line 16, 36, 56. A cross influence is prevented from occurring as a result, because all surge line control valves 5, 25, 45 open simultaneously and, if the controller setting is the same, also by the same amount.

If all three compressor stages 2, 22, 42 have left the dangerous working range, in which the flow is lower than is permissible, by opening the surge line control valves 5, 25, 45, the maximum selection members 14, 34 and 54 send the control deviation which closes the surge line control valve 5, 25, 45 with the smallest gradient to the anti-surge controller 15, 35, 55.

Figure 2:
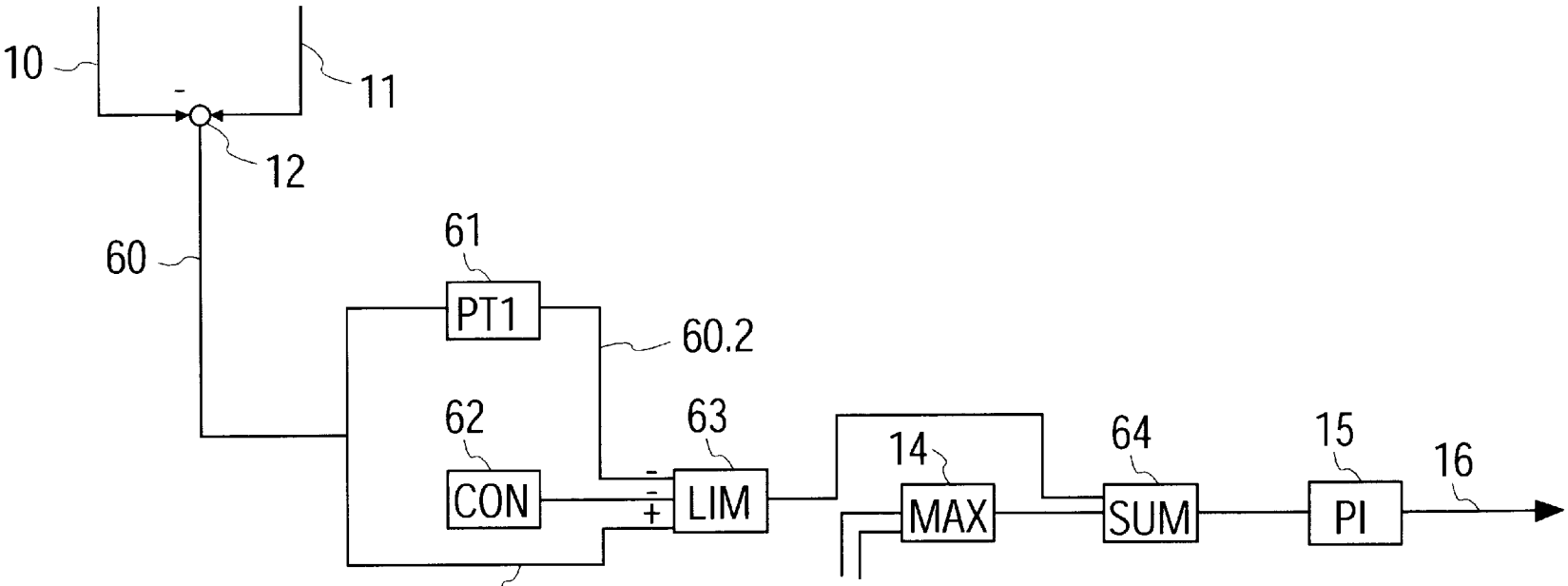
FIG. 2 is a circuit diagram of an interposed constant between a variance comparison unit and a anti-surge controller.

Corresponding to FIG. 2, a supplementary component may be interposed between the variance comparison units 12, 32 and 52 as well as the maximum selection 14, 34 and 54.

The control deviation determined in the variance comparison unit 12 is sent via the signal line 60 to a first-order time element 61 and to an adding limiter 63. This limiter 63 adds up the inputs correctly as to their signs, i.e., it subtracts from the control deviation the control deviation delayed via the time element 61. This difference is zero in the steady state, so that the adder 64 passes on only the signal of the maximum selection 14. The limiter 63 is set to a range of 0 to 1; it limits negative values to the value zero.

Should the working point now move toward the control line, the output signal 60.2 of the time element 61 will follow with a time delay. In the case of a greater change in the control deviation, the output signal of the limiter 63 may already become positive when the control deviation itself is still negative. On the other hand, the action of the correction variable disappears, i.e., the output of the limiter 63 becomes zero, when the control deviation stationarily assumes a value different from zero.

A constant 62 may be additionally also added to the limiter 63. This constant 62 causes an offset. The output of the limiter 63 becomes greater than zero only when the difference between the other two input variables 60.1 and 60.2 has exceeded the threshold value set as a constant.

This constant 62 may, of course, also be used without the delaying action of the PT1 member 61.

Another possibility of preventing influences of different control circuits on one another is to limit the gradient for changes in the manipulated variable.

Figure 3:
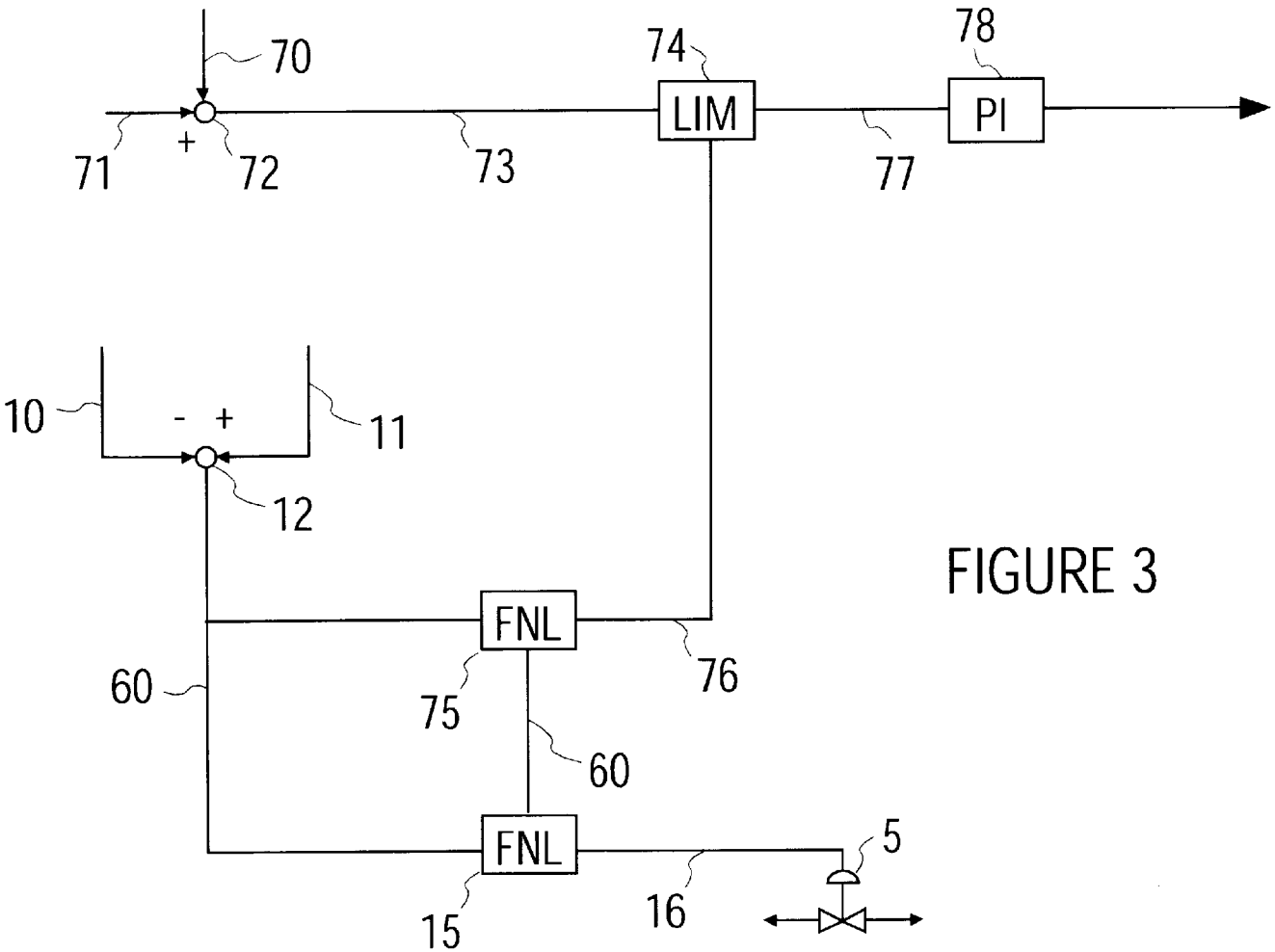
FIG. 3 is a circuit diagram for limiting the gradient for the variation of the manipulated variable.

According to FIG. 3, the difference between the current flow through the compressor and the minimum allowable flow is formed in the variance comparison unit 12 and is sent via a signal line 60 to the anti-surge controller 15, which adjusts the surge line control valve 5 via the control line 16 such that the turbocompressor will not be operated in the unstable working range.

The process variable set point (suction pressure, discharge pressure or flow) and the actual value of the process variable are sent to the comparison unit 72 via the signal lines 70 and 71. The difference between these two values acts via the signal line 73 and the limiter 74 on the process variable controller 78. This controller adjusts the corresponding control unit of the turbocompressor guide vanes, throttling valve or speed such that the actual value of the process variable exactly corresponds to the set point.

The upper and lower limits of the limiter 74 can be varied via the signal line 76 as a function of a process variable. In the case shown, the control deviation of the anti-surge controller 15 is used as the manipulated variable. The function generator 75 makes it possible to define a nonlinear relationship between the control deviation of the anti-surge controller and the effective limits of the limiter.

The process variable controller 78 responds to the input variable (output of 72) with its set response which can be set as a set of parameters. A great control deviation at the input causes the controller 78 to change its output variable rapidly, but the output changes only slowly in the case of a small control deviation at the input. The time response of the output variable can be influenced as desired by influencing the control deviation at the input of the process variable controller 78 in a controlled manner. Due to the limitation to zero by the limiter 74, the controller response can be clamped by the signal from 75. A change of the process variable controller as a response to a signal from 72 can be completely prevented from occurring, and the controller output 78 can even be controlled in the direction of higher output values by a controlled limitation to positive values even if the control deviation at the input wants the controller output to decrease.

Instead of influencing the control deviation of the process variable controller 78 in a controlled manner, it is also possible to act directly on the controller output, especially the proportional gain and the adjusting (reset) time from the function generator 75 via the control line 76. What is achieved by this control intervention is the same as what is achieved by the limiter 74 in the input of the process variable controller 78.

Figure 4:
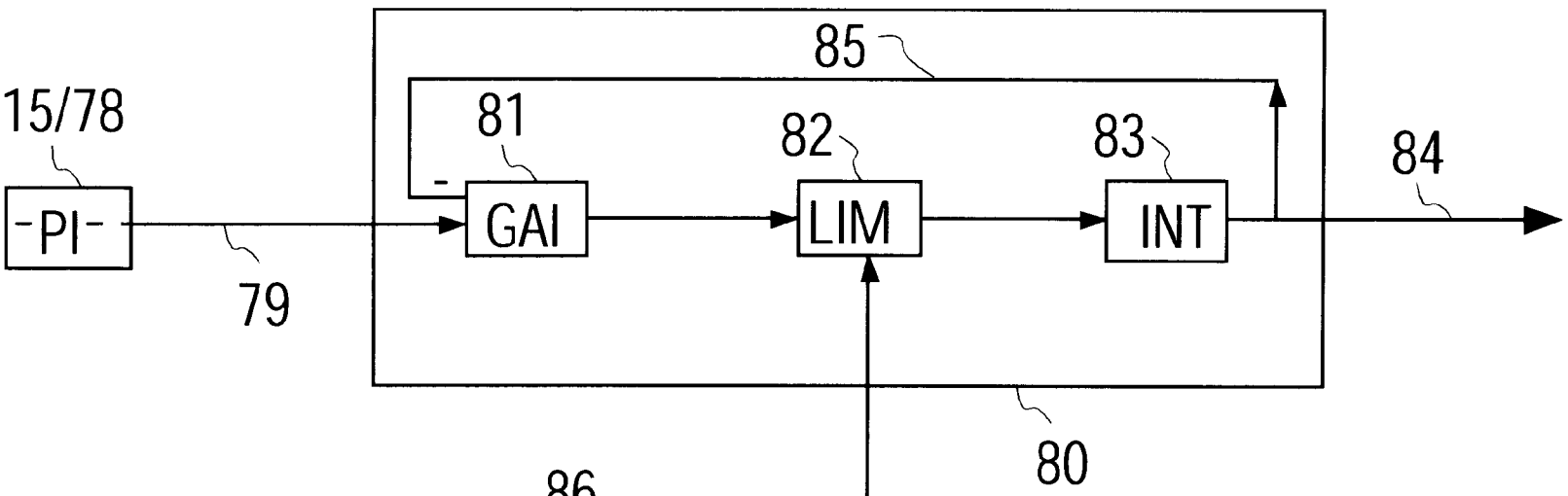
FIG. 4 is a circuit diagram of a gradient limiter after a process variable or anti-surge controller.

According to FIG. 4, a gradient limiter 80 is arranged downstream of the controller 15/78 (anti-surge controller 15 or process variable controller 78 ). The signal line 79 transmits the output variable of the controller 15/78 to the input amplifier 81. This amplifier 81 is set to a high gain, so that the limiter 82 receives a high input signal even in the case of a small deviation between the output of the controller 79 and the output of the integrator 83, fed back via the signal line 85. The limit values of the limiter 82 determine the gradient for the adjustment of the integrator 83. If the limiter 82 is set to low values, the integrator 83 receives only low input values and adjusts its output 84 only slowly even in the case of a deviation at the input of the amplifier 81.

The limit values of the limiter 82 can be adjusted via the control line 86 in the same manner as was described above for the limitation of the control deviation of the controller 15/78.

Figure 5:
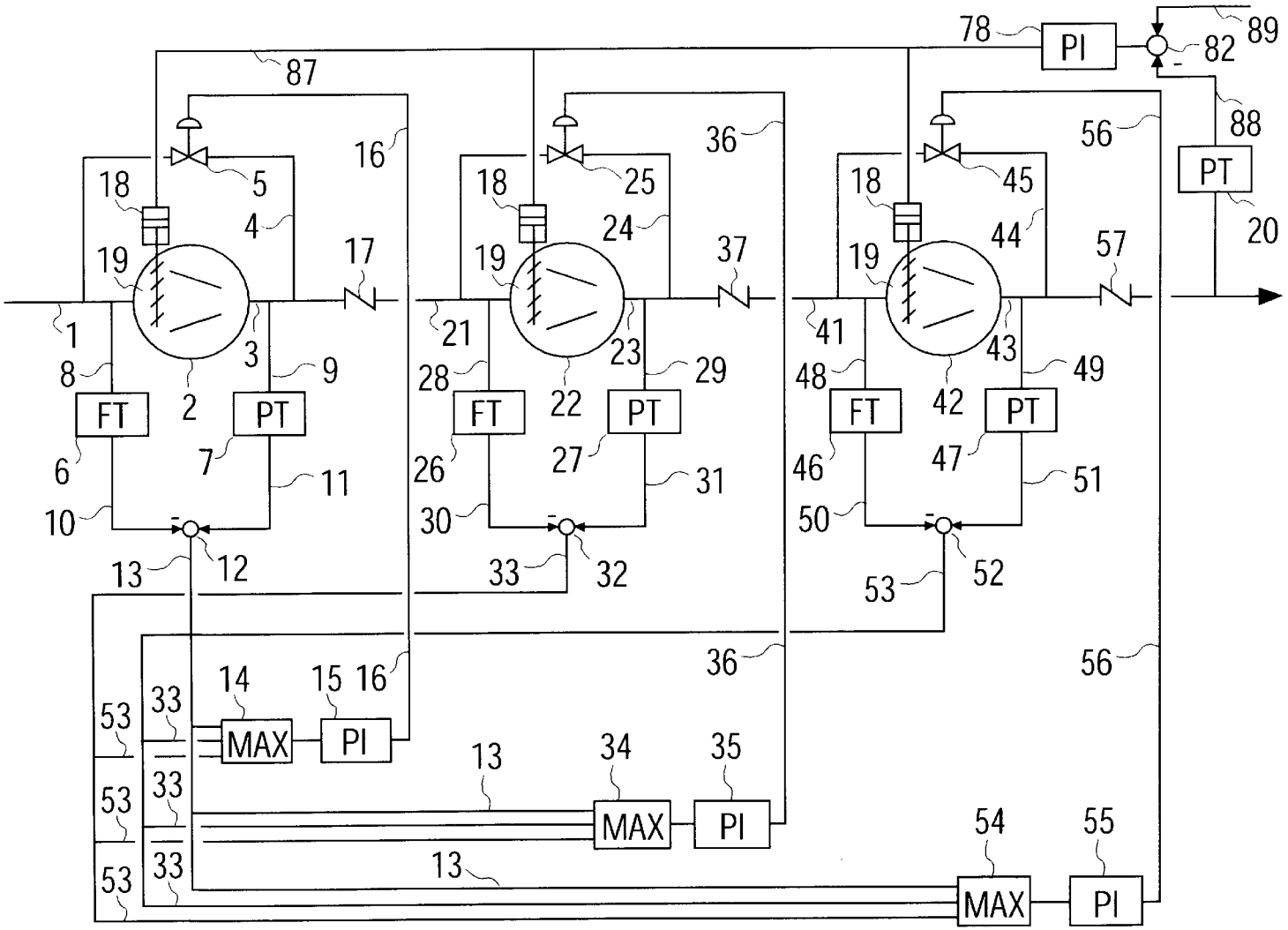
FIG. 5 is a circuit diagram corresponding to FIG. 1 with a pressure measuring transducer arranged at the pressure line.

FIG. 5 shows a circuit diagram corresponding to FIG. 1 with a pressure measuring transducer 20, which is arranged at the pressure line 43 after the check valve 57 of the third compressor stage 42 and sends control data via a signal line 88 to a comparison unit 82 and receives process variable set points 89 from the control system.

A process variable controller 78 transmits the controller output signal variables via a control line 87 to the actuating drives 18 for adjusting the guide vanes 19 in the low-pressure, medium-pressure and high-pressure turbocompressor stages 2, 22, 42.

Figure 6:
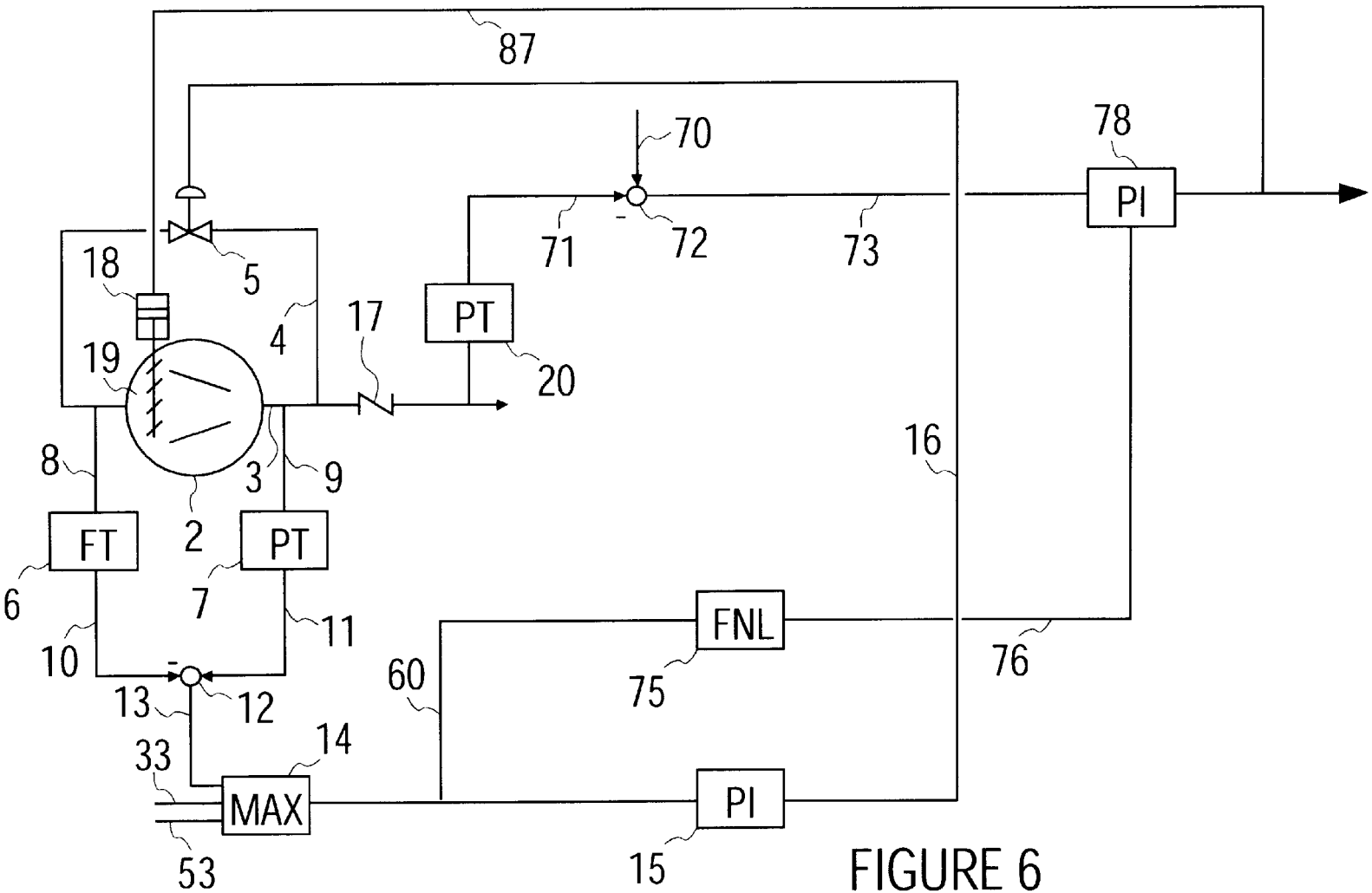
FIG. 6 is a circuit diagram of a turbocompressor stage, in which data from a maximum selection are additionally transmitted to a process variable controller.

According to FIG. 6, a pressure measuring transducer 20, which transmits control data via a control line 71 to a comparison unit 72 and passes them on to a process variable controller 78 via a signal line 73, may be arranged in the pressure line 3 of the low-pressure compressor 2 after the check valve 17.

Control data are transmitted by a maximum selection 14 from the comparison unit 12 to a function generator 75 and a anti-surge controller 15, wherein the maximum selection 14 receives more data via the control line 33 and 53 from the medium- and high-pressure stages.

Figure 7:
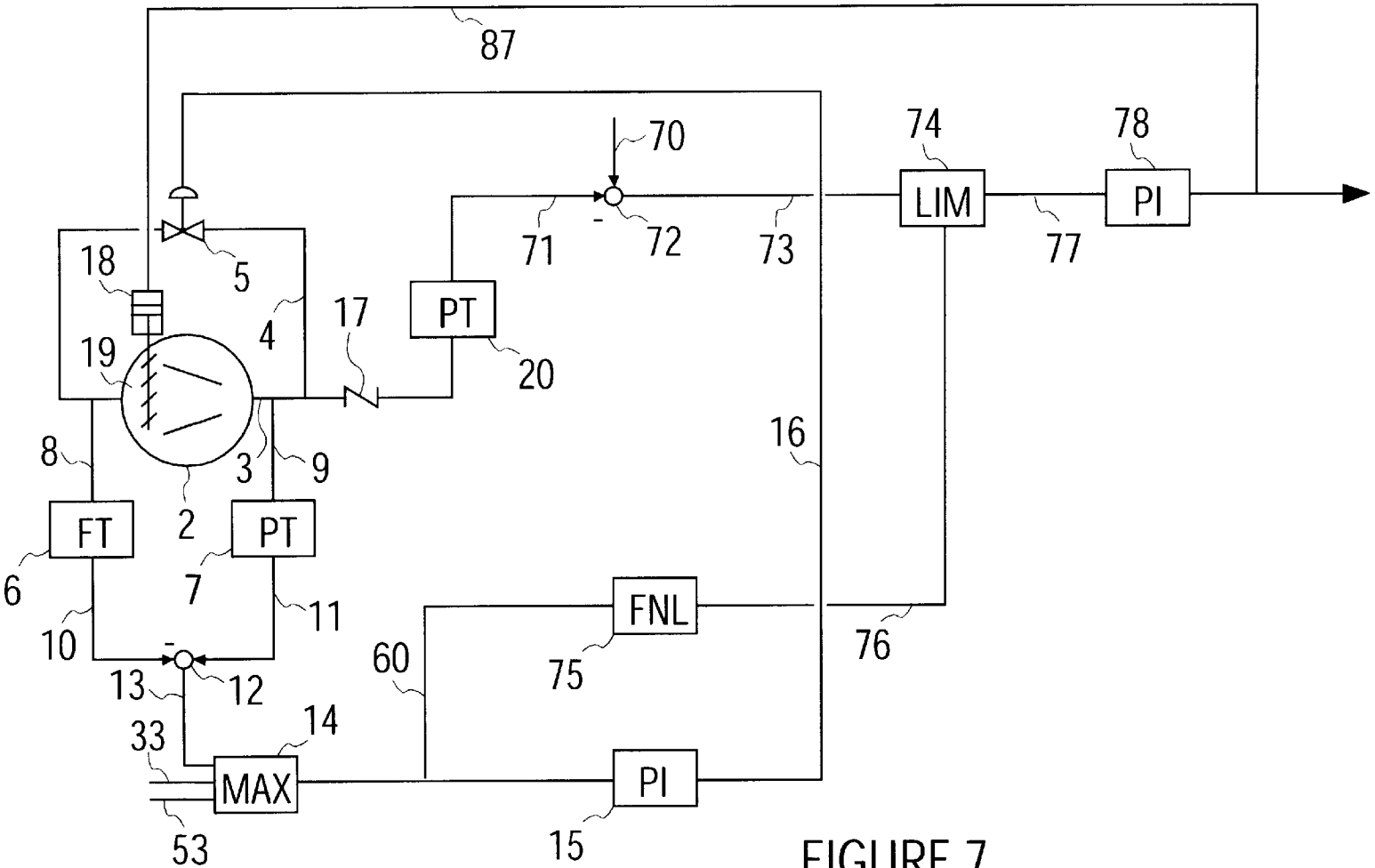
FIG. 7 is a circuit diagram of a turbocompressor stage, in which data from the maximum selection are transmitted to a limiter and then to a process variable controller.

FIG. 7 shows a circuit diagram of a low-pressure turbocompressor stage 2, in which the control deviations of the variance comparison unit 12 and from 33 and 53 are first sent to the maximum selection 14. As was described in connection with FIG. 6, these control data are sent to a anti-surge controller 15 and from there to the surge line control valve 5.

Moreover, control data from the maximum selection 14 may be sent to the function generator 75 via a control line 76 to a limiter 74, which is arranged upstream of the process variable controller 78. This 78 is connected via a control line 87 to the actuating drive 18 of the guide blades 19 of the low-pressure stage 2.

While specific embodiments of the invention have been shown and described in detail to illustrate the application of the principles of the invention, it will be understood that the invention may be embodied otherwise without departing from such principles.

APPENDIX

List of Reference Numbers:

| | |
|---|---|
| 1 | Suction line |
| 2 | Low-pressure compressor |
| 3 | Pressure line |
| 4 | Recycle line |
| 5 | Anti-surge control valve |
| 6 | Flow computer |
| 7 | Delivery head computer and set point former |
| 8 | Signal lines |
| 9 | Signal lines |
| 10 | Signal lines |
| 11 | Signal lines |
| 12 | comparison unit |
| 13 | Control line |
| 14 | Maximum selection |
| 15 | Anti-surge controller |
| 16 | Control line to 5 |
| 17 | Check valve |
| 18 | Actuating drive |
| 19 | Guide vanes |
| 20 | Pressure measuring transducer |
| 21 | Suction line |
| 22 | Medium-pressure compressor |
| 23 | Pressure line |
| 24 | Recycle line |
| 25 | Anti-surge control valve |
| 26 | Flow computer |
| 27 | Delivery head computer and set point former |
| 28 | Signal line |
| 29 | Signal line |
| 30 | Signal line |
| 31 | Signal line |
| 32 | Variance comparison unit |
| 33 | Control line |
| 34 | Maximum selection |
| 35 | Anti-surge controller |
| 36 | Control line to 25 |
| 37 | Check valve |
| 38 | |
| 41 | Suction line |
| 42 | High-pressure compressor |
| 43 | Pressure line |
| 44 | Recycle line |
| 45 | Anti-surge control valve |
| 46 | Flow meter |
| 47 | Delivery head computer and set point former |
| 48 | Signal line |
| 49 | Signal line |
| 50 | Signal line |

-continued

APPENDIX

List of Reference Numbers:

| | |
|---|---|
| 51 | Signal line |
| 52 | Comparison unit |
| 53 | Control line |
| 54 | Maximum selection |
| 55 | Anti-surge controller |
| 56 | Control line to 56 [sic - Tr.Ed.] |
| 57 | Check valve |
| 58 | |
| 60 | Signal line |
| 60.1 | Positive line |
| 60.2 | Negative line |
| 61 | Time element, first-order |
| 62 | Constant |
| 63 | Adding limiter |
| 64 | Summer/adder |
| 70 | Signal line |
| 71 | Signal line |
| 72 | Comparison unit |
| 73 | Signal line |
| 74 | Limiter |
| 75 | Function generator |
| 76 | Signal line |
| 77 | Signal line |
| 78 | PI controller/process variable controller |
| 79 | Signal line (controller output) |
| 80 | Gradient limiter |
| 81 | Input amplifier |
| 82 | Limiter |
| 83 | Integrator |
| 84 | Output line, gradient limiter |
| 85 | Signal line for feedback |
| 86 | Control line |
| 87 | Signal line |
| 88 | Signal line |
| 89 | Process variable set points from control system |

What is claimed is:

1. A method for operating turbomachines with at least two controllers that influence one with each other, the method comprising:

providing the first controller as a anti-surge controller;

exchanging correction variables of the first and the second controller providing a comparison based on a difference between a set point and the actual flow of the two controllers;

acting on the comparison of the two controllers and uncoupling the manipulated variable outputs of the two controllers such that a crossover influence is at least markedly reduced.

2. The method in accordance with claim 1, wherein the control deviation of the first controller acts on an extreme value selection before the second controller.

3. The method in accordance with claim 1, wherein the manipulated variable, which adjusts the surge line control valve at maximal manipulated variable speed acts from each controller on each control unit.

4. The method in accordance with claim 1, wherein the effective correction variable is determined from the difference between an original correction variable delayed in time by means of a first-order time element and the non-delayed variable.

5. The method in accordance with claim 4, wherein an offset is imposed on the correction variable.

6. The method in accordance with claim 4, wherein the correction variable limits the gradient for the adjustment of a manipulated variable of another controller.

7. The method in accordance with claim 6, wherein the gradient for limiting the manipulated variable is a linear or nonlinear function of the correction variable.

8. The method in accordance with claim 6, wherein the limitation for the manipulated variable is switched on or off depending on a process variable.

9. The method in accordance with claim 6, wherein the correction variable acts on the controller parameters and varies same.

10. A device for controlling the operation of multistage turbocompressors, the device comprising:

a comparison unit connected to one of the stages of the multistage turbocompressors and determining a difference between a set point (derived from delivery head) of the corresponding stage minus the actual value (flow);

another comparison unit connected to one of the stages of the multistage turbocompressors determining the difference between the set point (derived from delivery head) of the corresponding stage minus the actual value (flow);

a control line connected to said comparison unit;

another control line connected to said another comparison unit;

a maximum selector connected to each of said control line and said another control line;

another maximum selector connected to each of said control line and said another control line the connections from the control lines to the maximum selectors providing exchanged correction variables transferred from the variance comparison units via the control lines;

a anti-surge controller associated with a compressor stage, said maximum selector being arranged before said anti-surge controller;

another anti-surge controller associated with a compressor stage, said anti-surge controller and said another anti-surge controller influencing each other, said maximum selector being arranged before said another anti-surge controller of one said turbocompressor stage;

a surge line control valve with a connected control line, said surge line control valve being associated with a compressor stage, said anti-surge controller acting on said surge line control valve via said control line; and another surge line control valve with a connected control line, said another surge line control valve being associated with a compressor stage, said anti-surge controller acting on said another surge line control valve via said control line.

11. The device in accordance with claim 10, a first-order time element and an adding limiter are arranged following each comparison unit, said limiter adding up controller difference inputs correctly as to their signs and limiting them to adjustable limit values, and said adder passing on the controller difference determined (extreme value selection) to said anti-surge controller.

12. The device in accordance with claim 11, wherein a constant is imposed on the correction variable before said limiter.

13. The device in accordance with claim 10, wherein:

a function generator is inserted between said comparison unit and said limiter, and said comparison unit is directly connected to the said anti-surge controller via the said control line;

said additional comparison unit is coupled with said limiter, which passes on its data to a process variable controller, and said anti-surge controller is additionally coupled with the said function generator via a control line.

14. The device in accordance with claim 10, wherein a gradient limiter is arranged downstream of said controller, wherein data of said controller are transmitted to said input amplifier, said input amplifier is connected to said limiter, and said limiter is connected to an integrator; and output data are sent back to said input amplifier via said control line.

15. The device in accordance with claim 10, wherein:

a pressure measuring transducer, which transmits data to said variance comparison unit via a said control line, is arranged at said pressure line;

a process variable controller transmits the comparisons (controlled variables) via a control line to an actuating drive for adjusting guide vanes in the turbocompressor stages; and process variable set points are transmitted to said comparison unit from the control system.

16. The device in accordance with claim 15, wherein:

a pressure measuring transducer, which transmits data to said comparison unit via a control line and passes same on to a said process variable controller via a signal line, is arranged at said pressure line after said check valve;

said maximum selection transmits data from said comparison unit to a function generator and to said anti-surge controller;

said another maximum selection receives additional data via said control line and said another control line;

said anti-surge controller is connected to said surge line control valve via said control line; data are transmitted to said process variable controller via a process controller line; and said process variable controller transmits its data via process controller signal line to said actuating drive of said guide vanes in the turbocompressor stages.

17. The device in accordance with claim 15, wherein a function generator transmits data from said maximum selection via said control line to said limiter, which is arranged before said process variable controller.

18. The device in accordance with claim 16, wherein a function generator transmits data from said maximum selection via said control line to said limiter, which is arranged before said process variable controller.

* * * * *